US006568313B2

(12) United States Patent
Fukui et al.

(10) Patent No.: US 6,568,313 B2
(45) Date of Patent: May 27, 2003

(54) FLUID PRESSURE CYLINDER APPARATUS

(75) Inventors: Chiaki Fukui, Yawara-mura (JP); Shigeo Iinuma, Tokyo (JP)

(73) Assignees: SMC Kabushiki Kaisha, Tokyo (JP); Sakagami Seisakusho Ltd., Tokyo (JP)

( * ) Notice: Subject to any disclaimer, the term of this patent is extended or adjusted under 35 U.S.C. 154(b) by 80 days.

(21) Appl. No.: 09/799,717

(22) Filed: Mar. 7, 2001

(65) Prior Publication Data

US 2002/0124719 A1 Sep. 12, 2002

(51) Int. Cl.[7] ..... F01B 31/10
(52) U.S. Cl. ..... 92/168; 92/248
(58) Field of Search ..... 92/168, 248, 249, 92/253

(56) References Cited

U.S. PATENT DOCUMENTS 3,443,486 A * 5/1969 Lanman ..... 92/253
4,086,844 A * 5/1978 Homuth ..... 92/249

OTHER PUBLICATIONS

Shigeo Iinuma, "Recent Trends for Pneumatic Packings," Hydraulics & Pneumatics, 479, vol. 39, No. 6, pp. 27–38, Japan Industrial Publishing Co., Ltd. (May 1, 2000).

* cited by examiner

*Primary Examiner*—Edward K. Look
*Assistant Examiner*—Thomas E. Lazo
(74) *Attorney, Agent, or Firm*—Paul A. Guss

(57) ABSTRACT

A fluid pressure cylinder apparatus comprises a cylinder tube integrally connected between a head cover and a rod cover; a piston internally installed in the cylinder tube, for making displacement in accordance with an action of a pressure fluid supplied into the cylinder tube; and a piston rod connected to the piston; wherein a pair of first dust-removing members are installed on an outer circumferential surface of the piston with a piston packing intervening therebetween; and a second dust-removing member and a third dust-removing member are installed to an inner circumferential surface of a support section of the rod cover for the piston rod with a rod packing intervening therebetween.

4 Claims, 2 Drawing Sheets

FLUID PRESSURE CYLINDER APPARATUS

BACKGROUND OF THE INVENTION

1. Field of the Invention

The present invention relates to a fluid pressure cylinder apparatus which makes it possible to protect a sliding portion by removing minute dust or the like such as minute particles contained in a pressure fluid supplied from a pressure fluid supply source.

2. Description of the Related Art

For example, when a fluid circuit is constructed by incorporating a cylinder which is driven by the action of a pressure fluid supplied from a pressure fluid supply source, then any minute dust is generated in a fluid passage, for example, due to any deterioration of the flow passage piping of the fluid circuit, and the generated minute dust is contained in the pressure fluid in some cases.

Therefore, in the conventional technique, the pressure fluid is allowed to pass through a filter which is provided at a halfway position of the fluid passage through which the pressure fluid flows, and thus the dust in the pressure fluid is removed. On the other hand, the dust is removed at the inside of the cylinder by providing a scraper.

In the conventional technique, a cylinder is used, which is provided with, for example, a packing and a ring for holding the outer circumferential surface of a piston and the bearing portion of a piston rod in an air-tight manner.

However, in the case of the filter provided at the halfway position of the fluid passage for the pressure fluid, it is impossible to remove the dust which is generated in the fluid passage disposed downstream from the filter. Further, in a state in which the filter is deteriorated, the minute dust is not removed completely, and it arrives at respective sliding surfaces at the inside of the cylinder in some cases, because the dust passes through the deteriorated filter as well.

On the other hand, the scraper, which is provided at the inside of the cylinder, is designed such that the dust adhered to the sliding surface is swept out by means of a lip section so that the dust is removed. However, in view of its structure, for example, it is difficult to remove certain types of dust including, for example, the powder-shaped dust and the minute dust such as hair.

The piston rod, which is provided at the inside of the cylinder, has such a structure that a part of the piston rod is exposed to the outside in accordance with the displacement of the piston. Therefore, it is feared that the dust contained in the external fluid may adhere to the sliding surface of the piston rod, and the dust may enter the inside of the cylinder.

As a result, the following inconvenience arises. That is, if the dust enters the sliding surfaces of the piston of the cylinder and the bearing section for the piston rod, the sliding resistance is increased at the sliding portions of the cylinder. Further, for example, the abrasion and the deterioration of the piston packing, the rod packing, and other components are accelerated.

SUMMARY OF THE INVENTION

A general object of the present invention is to provide a fluid pressure cylinder apparatus which makes it possible to avoid any invasion of dust into respective sliding surfaces even when a pressure fluid contains the dust.

A principal object of the present invention is to provide a fluid pressure cylinder apparatus which makes it possible to avoid, for example, the increase in sliding resistance, the abrasion, and the deterioration at respective sliding surfaces by excluding the invasion of dust into the respective sliding surfaces.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
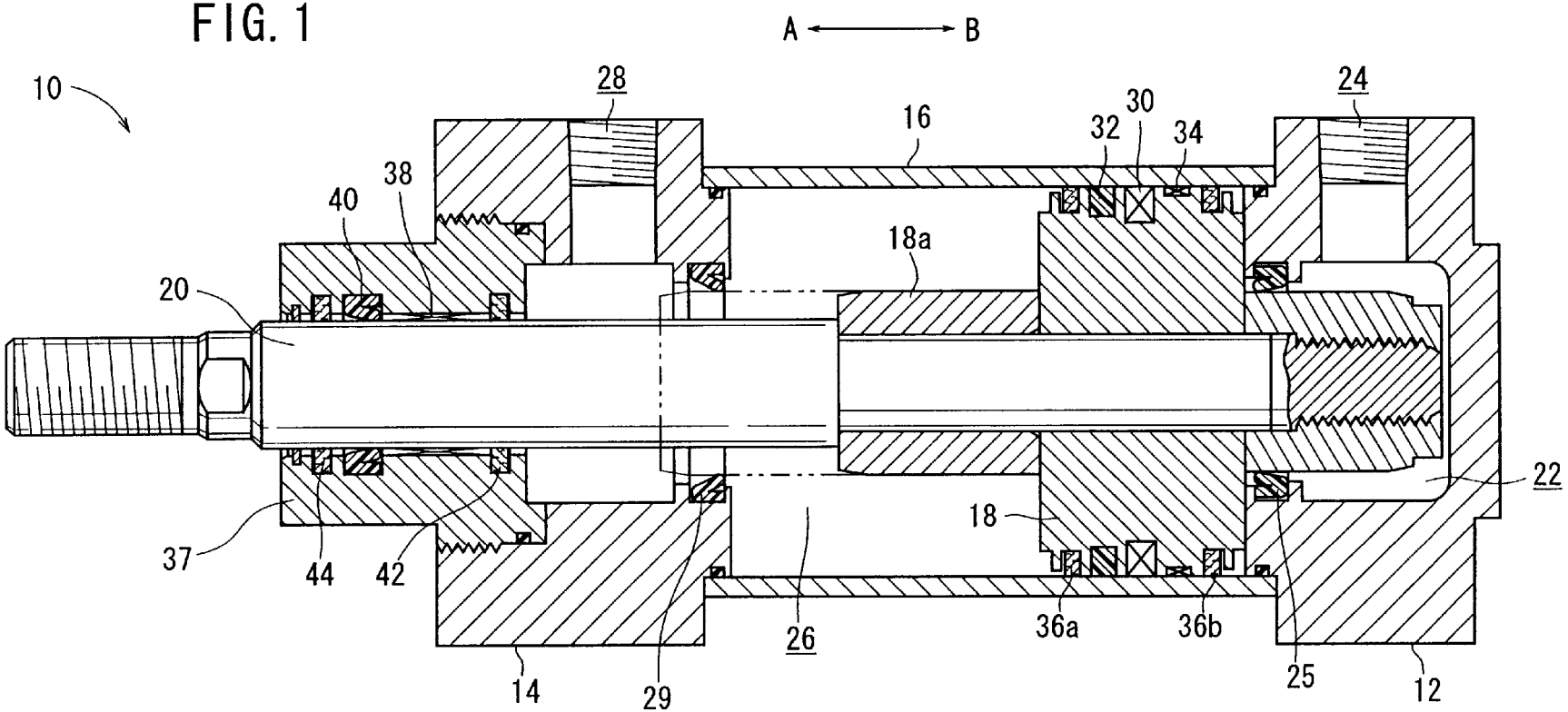
FIG. 1 shows a longitudinal sectional view taken in the axial direction of a fluid pressure cylinder apparatus according to an embodiment of the present invention.

A fluid pressure cylinder apparatus 10 according to an embodiment of the present invention is shown in FIG. 1.

The fluid pressure cylinder apparatus 10 basically comprises a cylinder tube 16 having a cylindrical configuration which is integrally connected between a head cover 12 and a rod cover 14, a piston 18 which is internally installed in the cylinder tube 16 and which is displaceable in the axial direction in accordance with the action of a pressure fluid supplied into the cylinder tube 16, and a piston rod 20 which is connected to the piston 18 and which is formed to have a stepped columnar configuration.

The head cover 12 is connected to the first end of the cylinder tube 16. A closed first cylinder chamber 22 is formed between the head cover 12 and the piston 18 disposed in the cylinder tube 16. A first pressure fluid inlet/outlet port 24, to which the pressure fluid is supplied from an unillustrated pressure fluid supply source and which communicates with a first cylinder chamber 22, is formed on the outer circumference side of the head cover 12.

A first packing 25, which is formed to have a V-shaped cross section, is installed to an annular groove disposed at an inner circumference portion of the head cover 12.

The rod cover 14 is connected to the second end of the cylinder tube 16. A closed second cylinder chamber 26 is formed between the rod cover 14 and the piston 18 disposed in the cylinder tube 16. A second pressure fluid inlet/outlet port 28, to which the pressure fluid is supplied from the unillustrated pressure fluid supply source and which communicates with a second cylinder chamber 26, is formed on the outer circumference side of the rod cover 14.

A second packing 29, which is formed to have a V-shaped cross section, is installed to an annular groove disposed on the inner circumference surface of a bearing section of the rod cover 14 through which the piston rod 20 is inserted.

The piston 18 is provided with a magnetic member 30 which is disposed at a substantially central portion and which has a magnetic field to be sensed by an unillustrated magnetic sensor, a piston packing 32 (first seal member) which holds the air-tightness of the first cylinder chamber 22 and the second cylinder chamber 26 respectively, a ring 34, and a pair of first dust-removing members 36*a*, 36*b* which are separated from each other by a predetermined spacing distance and which are arranged at both end portions in the axial direction with the piston packing 32 and other components intervening therebetween.

The piston 18 is provided displaceably in the axial direction in accordance with the action of the pressure fluid supplied from the first pressure fluid inlet/outlet port 24 and the second pressure fluid inlet/outlet port 28.

Figure 2:
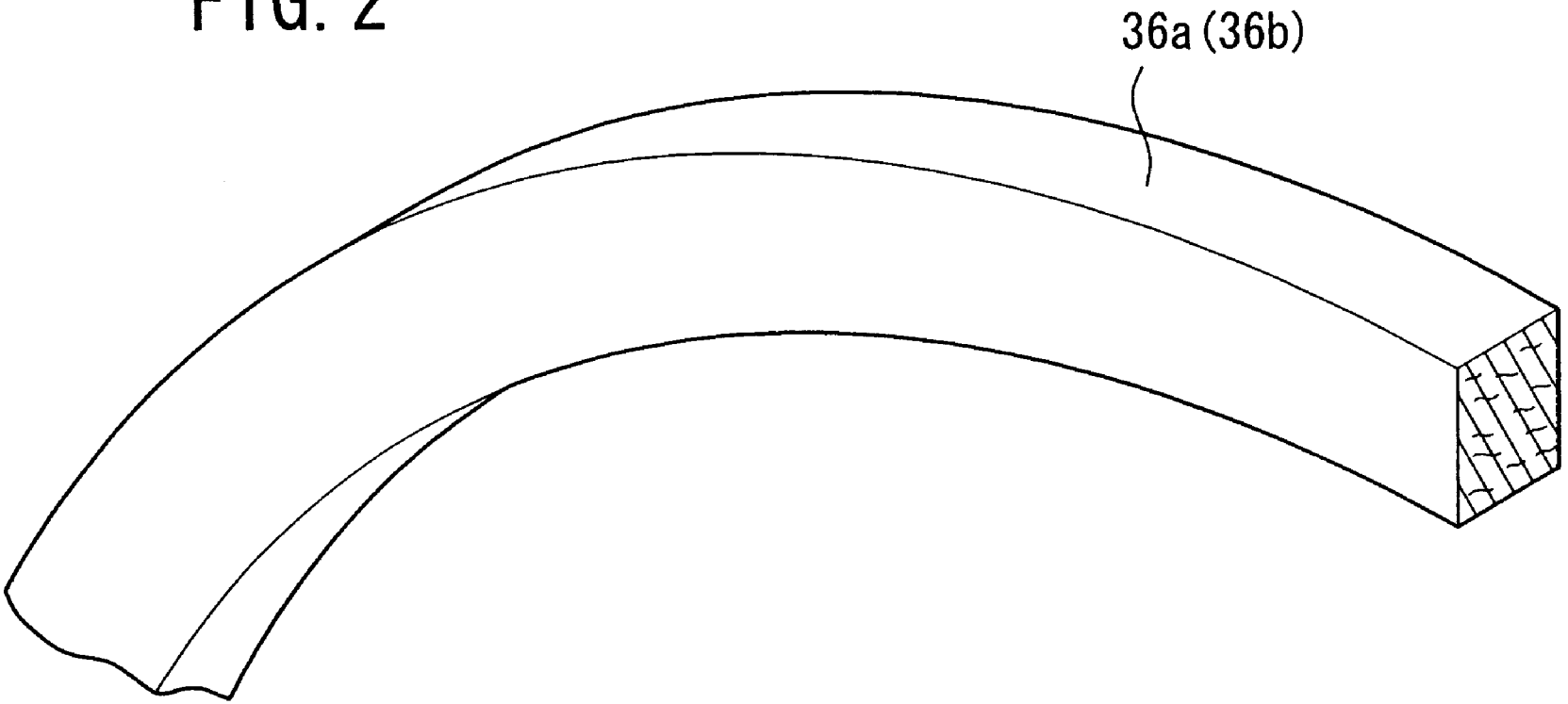
FIG. 2 shows, with partial omission and cutaway, a perspective view illustrating a first dust-removing member incorporated into the fluid pressure cylinder apparatus according to the embodiment of the present invention.

As shown in FIG. 2, each of the first dust-removing members 36*a*, 36*b* is formed as an annular member which is composed of, for example, a fiber material such as polyester, and a lubricant is contained in each of the first dust-removing members 36*a*, 36*b*.

As shown in FIG. 1, the first dust-removing member 36*b*, which is disposed on the first end surface side of the piston 18, functions to absorb and remove the dust from the pressure fluid to be supplied to the first cylinder chamber 22. On the other hand, the first dust-removing member 36*a*, which is disposed on the second end surface side of the piston 18, functions to absorb and remove the dust from the pressure fluid to be supplied to the second cylinder chamber 26.

As a result, the pair of first dust-removing members 36*a*, 36*b* have the function to prevent the ring 34 and the piston packing 32 installed to the sliding surface of the piston 18, from any invasion of the dust in the pressure fluid.

The piston rod 20 is connected to a substantially central portion of the second end surface of the piston 18. The first end of the piston rod 20 is supported displaceably by the aid of the rod cover 14.

A bush 38, a rod packing 40 (second seal member) which is formed to have a V-shaped cross section, and a second dust-removing member 42 which is arranged closely to the side of the second cylinder chamber 26 as compared with the rod packing 40 are installed respectively to annular grooves disposed on the inner circumferential surface of a support section (bearing section) 37 which is screw-fastened to the rod cover 14 and which supports the piston rod 20.

The second dust-removing member 42 is different in diameter from the first dust-removing members 36*a*, 36*b* shown in FIG. 2. However, the second dust-removing member 42 is the same as the first dust-removing member 36*a*, 36*b* in that it constructed by an annular member which is composed of a fiber material and in which a lubricant is contained.

As shown in FIG. 1, the second dust-removing member 42, which is disposed on the side of the piston 18, has the function to absorb and remove the dust in the pressure fluid to be supplied to the second cylinder chamber 26.

As a result, for example, the bush 38 and the rod packing 40, which are installed to the sliding surface of the piston rod 20, are prevented from any invasion of the dust in the pressure fluid by the aid of the second dust-removing member 42.

A third dust-removing member 44 for avoiding any invasion of the dust contained in the atmospheric air and lubricating the piston rod 20 is provided on the second side separated by a predetermined spacing distance from the second dust-removing member 42 with the rod packing 40 intervening therebetween.

The third dust-removing member 44 is different in diameter from the first dust-removing members 36*a*, 36*b* shown in FIG. 2. However, the third dust-removing member 44 is the same as the first dust-removing member 36*a*, 36*b* in that it is composed of a fiber material in which a lubricant is contained.

The fluid pressure cylinder apparatus 10 according to the embodiment of the present invention is basically constructed as described above. Next, its operation, function, and effect will be explained.

The following explanation will be made assuming that the initial position resides in a state in which the first end surface of the piston 18 abuts against the head cover 12 as shown in FIG. 1.

In this procedure, the first pressure fluid inlet/outlet port 24 and the second pressure fluid inlet/outlet port 28 are connected beforehand to the unillustrated pressure fluid supply source by the aid of unillustrated tubes. The unillustrated magnetic sensor is arranged at the outside of the cylinder tube 16. The magnetic field of the magnetic member 30 is sensed by the magnetic sensor. Accordingly, it is possible to detect the position of the piston 18.

At the initial position, the pressure fluid (for example, compressed air) is supplied from the pressure fluid supply source to the first pressure fluid inlet/outlet port 24. During this process, the second pressure fluid inlet/outlet port 28 and the second cylinder chamber 26 are in a state of communication with the atmospheric air in accordance with the switching action of an unillustrated directional control valve. The pressure fluid, which is supplied from the first pressure fluid inlet/outlet port 24, is introduced into the first cylinder chamber 22. The piston 18 is pressed in the direction toward the rod cover 14 (direction of the arrow A) in accordance with the action of the pressure fluid.

During this process, the first cylinder chamber 22 is held in the air-tight manner by the aid of the piston packing 32.

The dust in the pressure fluid supplied to the first cylinder chamber 22 is absorbed by the first dust-removing member 36*b* disposed on the side of the first end surface of the piston 18. Accordingly, the dust is preferably removed, and it is not discharged to the outside.

That is, for example, the powder-shaped minute dust is preferably entwined and eliminated with the inner circumferential surface of the first dust-removing member 36*b* which is formed in the superfine fibrous form. Accordingly, the sliding portion of the piston packing 32 or the like is prevented from any invasion of the dust.

As a result, for example, the ring 34 and the piston packing 32, which are provided on the sliding surface of the piston 18, are prevented from any invasion of the dust.

Simultaneously, the first dust-removing member 36*b* effects the lubricating function for the outer circumferential surface of the piston 18 and the inner circumferential surface of the cylinder tube 16.

When the piston 18 is displaced in the direction toward the rod cover 14 (direction of the arrow A), an annular projection 18*a* of the piston 18 is inserted into the second packing 29 to be sealed. Accordingly, the second cylinder chamber 26 is closed. During this process, the pressure fluid, which remains in the second cylinder chamber 26 is compressed. The shock, which is caused when the second end surface of the piston 18 abuts against the rod cover 14, is buffered in accordance with the action of the compressed pressure fluid.

When the second end surface of the piston 18 abuts against the rod cover 14, the piston 18 arrives at the displacement terminal position.

At the displacement terminal position at which the second end surface of the piston 18 abuts against the rod cover 14, the unillustrated directional control valve is switched to supply the pressure fluid from the pressure fluid supply source to the second pressure fluid inlet/outlet port 28. During this process, the first pressure fluid inlet/outlet port 24 and the first cylinder chamber 22 communicating therewith are in a state of communication with the atmospheric air.

The pressure fluid, which is supplied from the second pressure fluid inlet/outlet port 28, is introduced into the second cylinder chamber 26. The piston 18 is pressed in accordance with the action of the pressure fluid in the direction toward the head cover 12 (direction of the arrow B), i.e., toward the initial position.

During this process, the second cylinder chamber 26 is held in the air-tight manner by the aid of the piston packing 32 and the rod packing 40.

The dust in the pressure fluid supplied to the second cylinder chamber 26 is absorbed by the first dust-removing member 36*a* disposed on the side of the second end surface of the piston 18 and the second dust-removing member 42 provided for the support section 37 of the rod cover 14 for the piston rod 20. Accordingly, the dust is preferably removed, and it is not discharged to the outside.

That is, for example, the powder-shaped minute dust is preferably entwined and eliminated with the inner circumferential surface of the second dust-removing member 42 which is formed in the superfine fibrous form. Accordingly, the sliding portion of the rod packing 40 or the like is prevented from any invasion of the dust.

As a result, as for the rod cover 14, for example, the rod packing 40 and the bush 38 provided on the sliding surface of the support section of the piston rod 20 are prevented from any invasion of the dust.

Simultaneously, the first dust-removing member 36*a* effects the lubricating function for the outer circumferential surface of the piston 18 and the inner circumferential surface of the cylinder tube 16. The second dust-removing member 42 effects the lubricating function for the piston rod 20 and the support section for the piston rod 20.

Further, the third dust-removing member 44 avoids any invasion of the dust contained in the atmospheric air into the sliding portion, and it has the lubricating function for the piston rod 20.

When the piston 18 is displaced in the direction toward the head cover 12 (direction of the arrow B), the piston 18 is inserted into the first packing 25 to be sealed. Accordingly, the first cylinder chamber 22 is closed. During this process, the pressure fluid, which remains in the first cylinder chamber 22 is compressed. The shock, which is caused when the first end surface of the piston 18 abuts against the head cover 12, is buffered in accordance with the action of the compressed pressure fluid.

When the first end surface of the piston 18 abuts against the head cover 12, the piston 18 is restored to the initial position.

In the embodiment of the present invention, the pair of first dust-removing members 36*a*, 36*b*, which are separated from each other by the predetermined spacing distance, are provided on the outer circumferential surface of the piston 18. The second dust-removing member 42 is provided at the support section 37 of the rod cover 14 for the piston rod 20. Accordingly, it is possible to preferably prevent the dust in the pressure fluid from invasing into the sliding surfaces of the piston 18 and the piston rod 20.

Further, in the embodiment of the present invention, the third dust-removing member 44 is provided at the portion separated by the predetermined spacing distance from the second dust-removing member 42 with the rod packing 40 intervening therebetween. Accordingly, it is possible to preferably avoid the invasion of the dust contained in the atmospheric air, into the sliding surface of the piston rod 20.

It is noted that the lubricant is contained in the first to third dust-removing members 36*a*, 36*b*, 42, 44. Therefore, the absorption and the removal of the minute dust, which have been difficult for the conventional scraper, are successfully performed. Further, the lubrication for the sliding surface, which has not been performed with the conventional scraper, can be preferably performed.

As a result, the invasion of the dust is preferably excluded to avoid, for example, the abrasion and the deterioration of the piston packing 32 and the rod packing 40. Accordingly, the dust, which is generated, for example, by the piston packing 32, is not discharged to the outside. The environment for the external fluid for the fluid pressure cylinder apparatus 10 is maintained in a well-suited manner.

Further, the sliding resistance is reduced for the outer circumference of the piston 18 and the sliding surface of the support section 37 of the rod cover 14 for the piston rod 20. Accordingly, it is possible to prolong the maintenance cycle for the fluid pressure cylinder apparatus 10.

What is claimed is:

1. A fluid pressure cylinder apparatus comprising:

a cylinder tube integrally connected between a head cover and a rod cover;

a piston internally installed in said cylinder tube for making displacement in an axial direction in accordance with an action of a pressure fluid supplied into cylinder chambers;

a piston rod connected to said piston;

a seal member installed to a bearing section of said rod cover; and a second dust-removing member arranged closely to said cylinder chamber as compared with said seal member, for avoiding any invasion of dust into said seal member, wherein:

said second dust-removing member is formed of an annular member composed of a fiber material containing a lubricant.

2. The fluid pressure cylinder apparatus according to claim 1, wherein:

a third dust-removing member for avoiding any invasion of dust from the outside into said seal member is arranged on an inner circumferential surface of said bearing section of said rod cover; and said third dust-removing member is formed of an annular member composed of a fiber material containing a lubricant.

3. A fluid pressure cylinder apparatus comprising:

a cylinder tube integrally connected between a head cover and a rod cover;

a piston internally installed in said cylinder tube for making displacement in an axial direction in accordance with an action of a pressure fluid supplied into cylinder chambers;

a piston rod connected to said piston;

a first seal member installed to an outer circumferential surface of said piston;

a pair of first dust-removing members arranged on said outer circumferential surface of said piston to surround said first seal member, for avoiding any invasion of dust into said first seal member;

a second seal member installed to a bearing section of said rod cover; and a second dust-removing member arranged closely to said cylinder chamber as compared with said second seal member, for avoiding any invasion of dust into said second seal member, wherein:

each of said first dust-removing members and said second dust-removing member is formed of an annular member composed of a fiber material containing a lubricant.

4. The fluid pressure cylinder apparatus according to claim 3, wherein:

a third dust-removing member for avoiding any invasion of dust from the outside into said second seal member is arranged on an inner circumferential surface of said bearing section of said rod cover; and said third dust-removing member is formed of an annular member composed of a fiber material containing a lubricant.

* * * * *